United States Patent [19]

Granger

[11] 3,986,454

[45] Oct. 19, 1976

[54] MULTI-PURPOSE SIDE FRAMES FOR ROTARY PRINTING PRESS

[76] Inventor: Wallace H. Granger, P. O. Box 157, Kentfield, Calif. 94904

[22] Filed: Jan. 6, 1975

[21] Appl. No.: 538,790

Related U.S. Application Data

[63] Continuation of Ser. No. 377,580, July 9, 1973, abandoned, which is a continuation of Ser. No. 136,744, April 23, 1971, abandoned.

[52] U.S. Cl. ..... 101/216; 101/177; 101/180; 101/181; 101/247; 241/230

[51] Int. Cl.[2] ..... B41F 5/04; B41F 13/28; B41F 13/30

[58] Field of Search ..... 101/177, 247, 179, 180, 101/182, 212, 216, 217, 218, 219, 220, 221, 181; 308/62; 241/230

[56] References Cited

UNITED STATES PATENTS

| | | | |
|---|---|---|---|
| 301,942 | 7/1884 | Wilson | 101/216 |
| 1,590,742 | 6/1926 | Goulding | 101/218 |
| 1,725,715 | 8/1929 | Mac Callum | 241/230 X |
| 1,901,075 | 3/1933 | Bechman | 101/220 |
| 2,055,319 | 9/1936 | Smith | 101/221 |
| 2,688,915 | 9/1954 | Shelton | 101/212 X |
| 2,711,935 | 6/1955 | Miles | 308/62 |
| 3,072,050 | 1/1963 | Wolff | 101/177 |

*Primary Examiner*—Clifford D. Crowder
*Assistant Examiner*—R. E. Suter
*Attorney, Agent, or Firm*—Gregg, Hendricson, Caplan & Becker

[57] ABSTRACT

An improvement in printing presses wherein main press side frames are provided with circumferential slots about the axis of plate or printing cylinders for receiving sectional or reversible mounting blocks for carrying impression cylinders. The mounting blocks have eccentrically mounted cylinder bearings and adjustment means are provided for precisely locating the blocks in the slots. The Invention provides for ready changing of the press from letterpress to offset or planographic printing.

4 Claims, 8 Drawing Figures

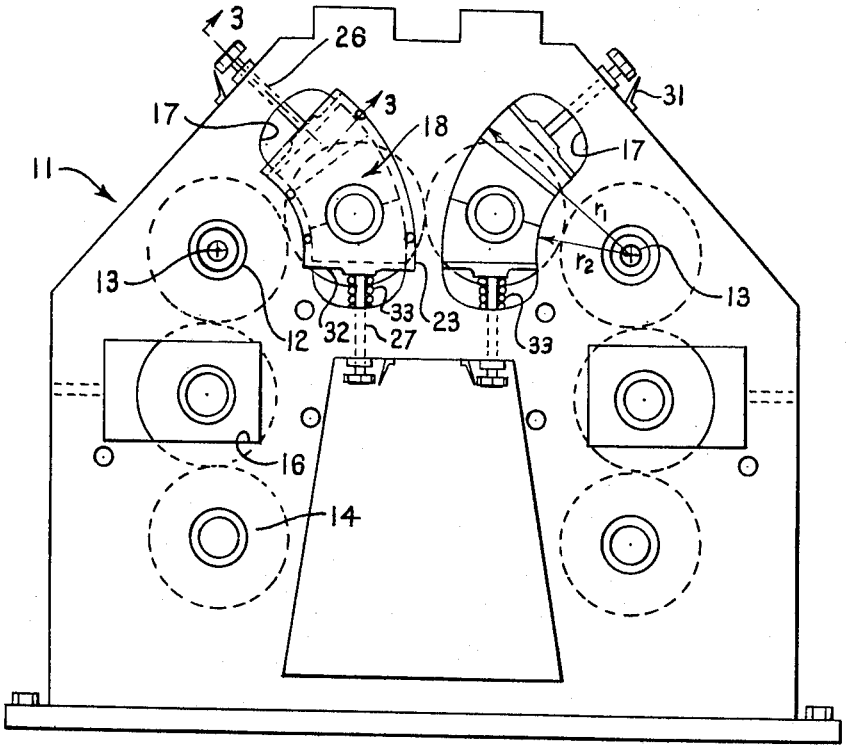
FIG. 1
FIG. 2A
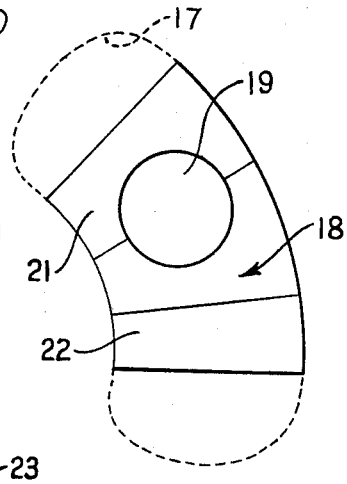
FIG. 2B
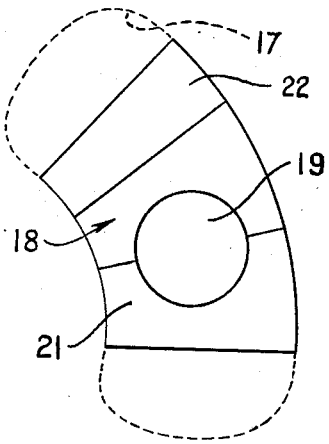
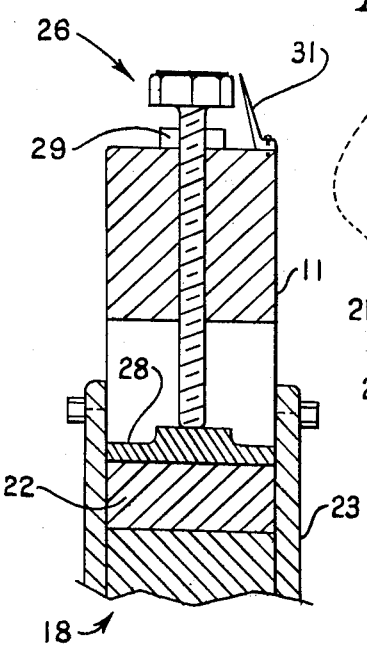
FIG. 3

MULTI-PURPOSE SIDE FRAMES FOR ROTARY PRINTING PRESS

This is a continuation of my prior U.S. Pat. application Ser. No. 377,580, filed July 9, 1973 for "Multi Purpose Side Frames for Rotary Printing Press", and now abandoned, which was a continuation of my U.S. Pat. application Ser. No. 136,744 filed Apr. 23, 1971 and now abandoned.

BACKGROUND OF INVENTION

Printing is generally divided into certain basic types including what may be generally termed letterpress, offset and flexographic. Each of these types have been adapted to rotary printing presses and letterpress and offset are commonly employed in large and small printing press installations including newspaper printing presses. Letterpress printing provides for the transfer of an impression from the raised surfaces of printing plates to paper passed between a plate cylinder carrying such plates and a resiliently covered impression cylinder. On the other hand, offset printing provides for the transfer or offset of prints from a plate by the utilization of an intermediate offset cylinder or blanket cylinder. Modern offset printing presses normally print blanket-to-blanket, i.e., employ the blanket cylinder for one side of the sheet as the impression cylinder for the other so that printing is accomplished on both sides of the sheet simultaneously. As an intermediate to letterpress and offset there has been developed planographic printing which employs a smooth surfaced plate, chemically treated so that the portion of the plate that is to do the printing is the only portion to which printing ink will adhere. The printing takes place directly on the sheet of paper. The printing surface of a planographic plate is on the order of an offset plate with the exception that the typematter is set in reverse. offset plates and planographic plates are on the order of 7 to 30 thousandths of an inch in thickness and are flexible.

Many press installations, particularly in the field of rotary printing presses for newspapers, are designed for the use of stereotype letterpress printing plates. Oftentimes, however, it is desired to convert from letterpress to offset printing particularly in the field of newspaper printing. This is a major operation requiring the construction and fabrication of complete new printing presses which is not only costly but also time consuming. Dummy mounting saddles are presently available on which to attach thin offset or planographic printing plates, thus plate cylinders do not necessarily have to be changed when methods of printing are changed.

Although many of the elements of a rotary stereotype printing press may be employed in an offset press, it has not heretofore been possible to convert one type of press to the other. In an offset press the combined impression and offset cylinders are mounted in a different position and thus it has been necessary to employ different press side frames for different types of printing. This then requires the installation of completely new presses. It is furthermore noted that the thickness of printing plates employed in letterpress and offset printing are markedly different and consequently a plate cylinder that is designed for the use of stereotype printing plates must be made adaptable for the use of offset printing plates or planographic printing plates. A plate cylinder designed for the use of stereotype plates is usable in the present press but a change of cylinders is recommended if the press is to be permanently converted from letterpress to offset. The change can however, be made "in the field" without press alteration other than the change of said cylinders. If plate cylinders designed for the use of stereotype printing plates are to be retained, then it will be necessary to employ dummy mounting plates when the offset or planographic printing method is employed.

While it would be highly advantageous to be able to progressively convert individual press units of a multible unit installation from stereotype letterpress to offset printing, such has been previously precluded by the above-noted difficulties. The present invention provides for such a successive conversion.

SUMMARY OF INVENTION

There is provided by the present invention an improvement in rotary printing presses, particularly with regard to the main side frames of such press. Although the present invention is not limited to the printing of newspapers, it is hereinafter described in connection with rotary newspaper printing presses.

Improved main side frames for a rotary printing press are herein provided with semicircular arcuate slots located within the confines of said frames about the axes of plate cylinder mountings and adapted to receive arcuate sectional or reversible mounting blocks for carrying impression cylinders. The mounting blocks are positioned within the above-noted arcuate slots and the impression cylinder bearings are eccentrically mounted in the blocks. The repositioning of a section of the block from underneath the cylinder bearing to a position above the cylinder bearing or vice-versa, provides for moving the impression cylinder between positions for letterpress or offset printing. In the case where the blocks are not sectional, they can be turned upside down to accomplish the cylinder shift.

The present invention additionally provides adjusting means for precise positioning or repositioning of mounting blocks in the main press frame slots and furthermore provides eccentric bearing housings in the mounting blocks with control means therefor. Thus the position of the impression cylinders may be precisely adjusted to accommodate the press for either letterpress or offset printing.

A printing press incorporating the present invention is also contemplated to include additional means accommodating the press to letterpress, planographic or offset printing. It will be appreciated that for blanket-to-blanket offset printing the impression cylinders of a dual press normally rotate in the opposite direction from letterpress or planographic printing and thus other cylinders of the press are likewise operated in a reverse direction. The improved inking system for rotary printing presses disclosed in my U.S. Pat. Nos. 3,587,463 and 3,585,932 is applicable to the present invention with minor modifications. Thus the inking fountain is formed to accommodate rotation of the inking cylinder in either direction and the ink removal cylinder engaging the ink transfer cylinder or form roller of the system is movable between opposite sides of the ink transfer cylinder. The capability of the ink transfer cylinder to be adjustably positioned is retained herein.

The printing press can be adapted for offset printing from stereotype letterpress or planographic printing by altering one printing unit at a time by replacing the stereotype plate cylinders with offset plate cylinders or equipping the plate cylinders with dummy mounting plates and repositioning the impression cylinders and the changed over unit (s) can be operated as part of the whole press as the transition of the printing units progresses, part of the press being operated with stereotype letterpress or planographic printing plates and part with offset printing plates. If the offset printing is by the "wet" method, printing plate dampening units (not shown) will be required and the press side frames will be drilled and tapped at the time of manufacture for ready mounting of the dampening unit. The dampening unit is not required if the printing process is "dry" offset.

Heretofore it has been necessary to manufacture press side frames in accordance with the requirements of the cylinder diameters. The press side frames of the invention will accomodate cylinders for different lengths of the sheet cut-off whether the printing press be letterpress or offset by placing the mounting holes in the impression cylinder mounting blocks closer to or farther away from the plate cylinder. The plate cylinder and the inking cylinder are mounted "firm" and the ink transfer cylinder (form roller) is mounted in a slidable bearing that allows straight line movement of the cylinder away from or toward the plate and inking cylinders thus allowing for a change in cylinder diameters without a change in press side frames.

Thus with the multi purpose side frames of the present invention and the improved inking system of my above-noted U.S. patents, there is provided the capability of relatively simple and inexpensive transformation from letterpress or planographic printing to offset printing without the necessity of replacing the printing press.

DESCRIPTION OF FIGURES

The present invention is illustrated as to particular preferred embodiments thereof in the accompanying drawings wherein:

FIG. 1 is a side elevational view of an improved main press side frame in accordance with the present invention;

FIGS. 2A and 2B are side elevational views of a sectional mounting block in first position and second position as may be employed in the side frames of the present invention;

FIG. 3 is a sectional view taken in the plane 3—3 of FIG. 1 and illustrating mounting block adjustment means;

DESCRIPTION OF PREFERRED EMBODIMENTS

Figure 4:
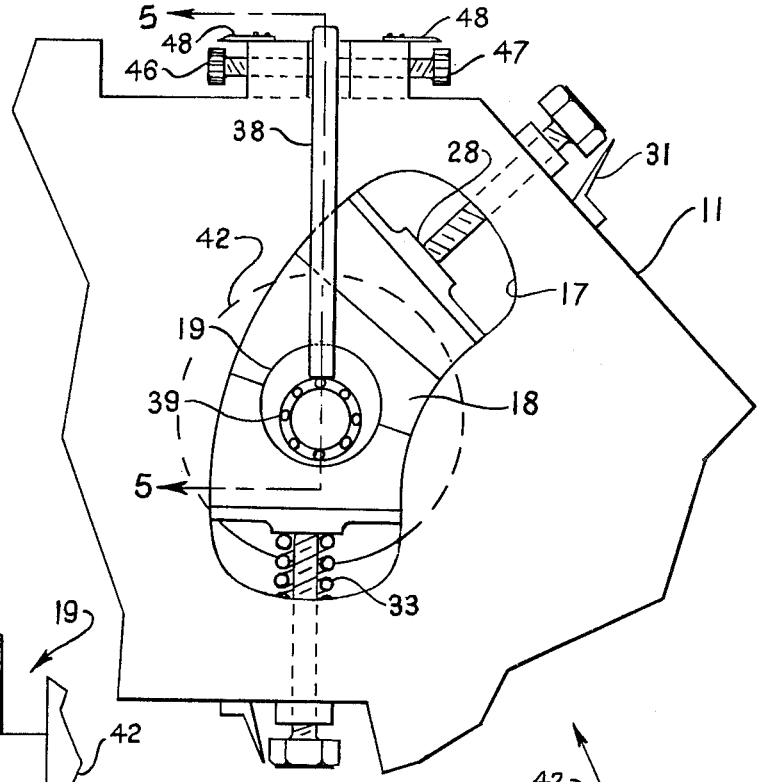
FIG. 4 is a partial side elevational view of a press side frame in accordance with the present invention and illustrating eccentric bearing adjustment means.

The present invention is applicable to a relatively conventional rotary newspaper printing press, for example. Such a press incorporates relatively massive, rigid main side frames between which the cylinders, drums and rollers of the press are mounted. There is illustrated in FIG. 1 a press side frame 11 having openings therein for receiving bearings to rotatably mount cylinders and the like of a dual press having two printing couples. The openings 12 are provided for the end bearings of a plate cylinder or printing cylinder having an axis 13 at the center of the openings 12. The openings 14 are adapted to receive end bearings for an inking cylinder of my above-noted improved inking system and the openings 16 accommodate mounting of movable bearing blocks for the ink transfer cylinders of such system. Inasmuch as the right and left hand portions of the printing couple of a dual press are substantially the same, the following description is primarily referenced to but a single side of the press. The present invention is also applicable to a vertical press wherein impression or blanket cylinders are disposed one above the other.

The side frames of the present invention each include a pair of arcuate slots 17 having the same radii of curvature and centered on the two plate cylinder axes 13. The slots 17 have the lower end thereof disposed between the plate cylinder axes 13 and curve upwardly and away from each other for about 60 degrees of arc along constant radii, as indicated by $r_1$ and $r_2$ in FIG. 1. The side frame slots are provided for the purpose of mounting impression cylinders of blanket cylinders of a printing couple and to this end there are provided arcuate sectional mounting blocks 18 adapted for disposition within the slots 17. The mounting blocks 18 are apertured to carry bearing housings 19, described in more detail below. Cylinder openings 12 and arcuate slot openings 17 are located equal distances on opposite sides of the centerline of the press.

Further with regard to the mounting blocks 18 and referring to FIGS. 2A and 2B, it will be seen that the block is preferably formed of a main portion 21 surrounding the bearing housing 19 and a filler portion 22 abutting the main portion longitudinally of the block. As noted above, the mounting block 18 has an arcuate configuration and is dimensioned to slipfit the slot 17 with the main and filler portions of the block aligned longitudinally of the slot. The slot length is slightly greater than the overall length of the mounting block and the filler portion of the block is adapted to be disposed at either end of the main portion 21 of the block. As is clearly shown in FIG. 2, reversal of the portion of the filler portion 22 of the mounting block provides for relocation of the bearing housing 19 adapted to rotatably carry the impression cylinder or blanket cylinder of the press. The mounting blocks are retained in the side frame slots 17 by plates or the like 23 which may be bolted to the inside and outside of the frame, as indicated in FIG. 3.

Provision is made for adjusting the position of the mounting blocks 18 in the slot 17 and to this end there may be provided upper and lower adjusting screws 26 and 27 respectively. The upper adjusting screw 26, as illustrated in FIG. 3, is threaded through the frame 11 from the top thereof to extend longitudinally into the slot 17 and carries a contact plate 28 on the bottom thereof. This contact plate 28 is adapted to engage the upper surface of the mounting block 18 and it will be seen that by turning the adjusting screw 26, the location of this contact plate within the slot is adjustable. A lock nut 29 may be provided for fixing the adjusted position of the contact plate and thus the upper surface of the mounting block. The adjusting screw 26 is preferably provided with calibrations about the head thereof and a pointer 31 secured to the frame cooperates therewith for indicating the position of the adjusting screw. The lower adjusting means 27 may be formed in the same manner as the adjusting means 26 described above and extends in threaded engagement upwardly through the press side frame with a contact plate 32 at the inner end of the adjusting means or screw to engage the underside of the mounting block. Indicating means may also be provided on the adjusting screw 27. A heavy duty coil spring 33 is preferably provided about the lower adjusting screw 27 so that in compression the spring removes much of the load on the screw. Thus the adjusting screws or means 26 and 27 will be seen to be movable to fix the position of the mounting block in the slot 17. It will furthermore be appreciated that the mounting block is maintained at all times at the same distance from the printing cylinder axis 13 inasmuch as any movement of the block in the slot must be about the circumference of a circle about such axis. It is also possible to employ wedges in place of the adjusting screws. The same mounting and adjusting means is applied to both ends of the cylinder.

Figure 5:
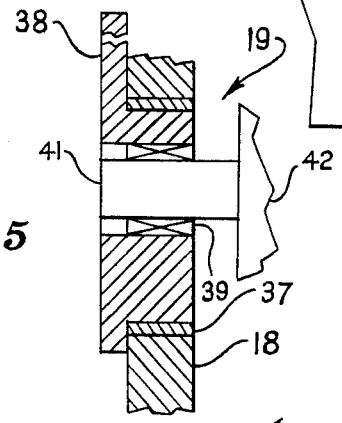
FIG. 5 is a sectional view taken in the plane 5—5 of FIG. 4 and illustrating the eccentric bearing housing of a mounting block and adjustment means for the bearing with the bearing housing inverted.

The present invention provides an additional degree of positioning of the blanket or impression cylinder of a rotary printing press. Such is herein provided by an eccentric bearing housing 19 disposed in the mounting block 18. Referring now to FIGS. 4 and 5, there is illustrated a mounting block 18 in position within a side frame slot 17 with the side retaining plates removed for clarity. The eccentric bearing housing 19 is rotatably mounted within the arcuate shaped mounting blocks 18 as by a bearing or bushing 37 and has a radial extending arm 38 disposed, for example, upwardly of the press frame and on the inner or outer side thereof. An anti-friction bearing 39 extends through the bearing housing 19 offcenter thereof and is adapted to mount a trunnion 41 of an impression cylinder 42. The bearing 39 is retained in the cylinder housing 19 and may, for example, be of the tapered roller bearing type adjustable to zero clearance to prevent any side play of the cylinder trunnion. Thrust bearings may also be provided to prevent end play of the cylinder; however, such are not illustrated herein. The bearing arm 38 extends alongside the side frame 11 as, for example, upwardly thereof whereat a pair of adjusting screws 46 and 47 are mounted in or on the side frame for engagement with opposite sides of the arm. Turning of these adjusting screws 46 and 47 will be seen to pivot the arm 38 and the eccentric bearing housing 19. This then serves to controllably move an impression or blanket cylinder carried by the eccentric housing. Screws 46 and 47 are equipped with calibrated dials and pointers 48 cooperate therewith to facilitate accurate positioning of cylinder 42. The same adjustment means applies to both ends of the cylinder(s). The segment holding adjustment screws 47 and 48 may be made movable on the press frame.

Figure 6A:
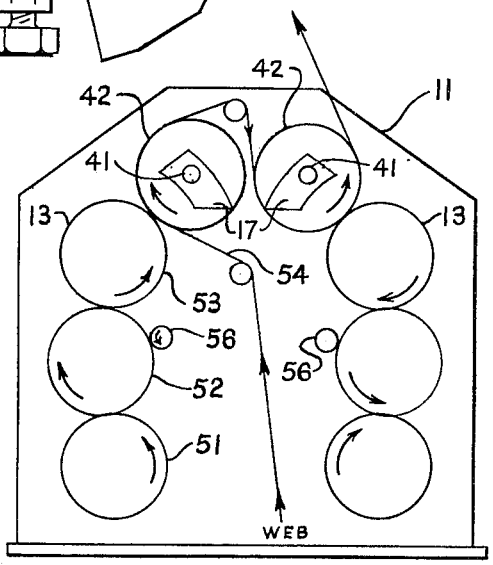
FIGS. 6A and 6B are schematic illustrations of a single rotary printing press set up for letterpress printing and offset printing, respectively.

Considering briefly operations involved in accordance with the present invention for changing a rotary newspaper printing press from planographic or letterpress printing to offset printing, reference is first made to FIG. 6A showing the general arrangement of cylinders in a printing couple for letterpress or planographic or direct printing. The inking portions of the printing unit are not described herein inasmuch as they are fully set forth in my U.S. Pat. No. 3,585,932. It is, however, noted that each couple includes an inking cylinder 51 rotating in contact with an ink transfer cylinder 52 that in turn rotates in contact with a printing or plate cylinder 53. The direction of rotation of the cylinders of the press are indicated in FIG. 6A as is the direction of traverse of the web 54 adapted to be printed upon by the press. The impression and plate cylinders 42 and 53 are in rolling contact with the web passing therebetween, as indicated, and an ink removal cylinder 56 engages the ink transfer cylinder 52 for removing surplus ink after ink transfer to the plate cylinder and return of same to a sump for ink recycling. The impression cylinders are seen to be mounted by the mounting blocks 18 with the bearings at the top of the blocks to position the impression cylinders for proper contact with the plate cylinders for letterpress or direct printing.

Modification of the press for offset printing requires, among other things, repositioning of the impression cylinders 42. This is accomplished in accordance with the present invention by first applying an upward force to an impression cylinder to relieve the strain on the bearings as, for example, by strapping the cylinder to an overhead crane and taking a strain on the strap. The mounting block side plates 23 are then removed and the filler section 22 of the mounting block moved laterally out of the arcuate slot 17. This is accomplished by first backing off on the adjusting screw 26 and then sliding the block 22 laterally out of the frame. With the foregoing accomplished at both ends of an impression cylinder, the cylinder is then lowered as by means of the crane holding same, so that the main portion 21 of the mounting block 18 in each side frame slides downwardly in the side frame slots 17 into engagement with the lower adjusting means 27. The filler portion 22 of the mounting block is then laterally inserted at the top of the main portion of each block by sliding the filler portion laterally into the slots in the frame. The side retaining plates 23 are then attached to the side frames of the press to retain the mounting blocks in the side frames.

Figure 6B:
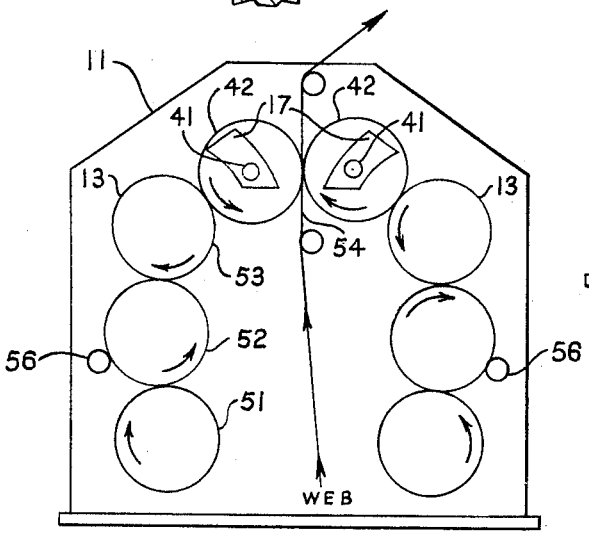

Normally in a conversion of this type, the plate cylinder is replaced and this may be accomplished in accordance with conventional procedures or dummy mounting plates can be attached to the plate cylinders and the thin wraparound offset printing plates can be attached thereon. Additionally, the drive for the cylinders of the press is reversed. The impression cylinders have the gears thereof out of contact when the press is set up for letterpress or planographic printing so the printing couples can be operated in reverse for dual color letterpress printing on a chosen side of the web and the impression cylinder gears mesh in the offset printing position for printing offset on one or both sides of the web. With the improved inking system of my above-identified U.S. patent, the ink removal cylinder 56 is moved to the opposite side of the ink transfer cylinder as indicated in FIG. 6B. The inking cylinder rotates in an ink fountain which may either be formed for operation in either direction of ink cylinder rotation or, if necessary, may be reversed to ensure that an even coating of ink having a desired thickness is applied to the inking cylinder as it leaves the fountain.

Small adjustment of the location of the blanket cylinder 42 is provided by the adjusting means 26 and 27 and further precise adjustment is achieved by the eccentric bearing housing 19. A slight rotation of this eccentric bearing housing produces a slight displacement of the blanket cylinder so as to achieve very precise positioning of the blanket cylinders relative to each other and to the plate cylinders. It will, of course, be appreciated that the relative sizes of the portions of the mounting block are predetermined so that reversal of the position of the filler portion substantially locates the impression or blanket cylinder in the proper position for the particullar printing to be accomplished by the press. The final press configuration for offset printing is illustrated in FIG. 6B.

The present invention is also able to accommodate a change in sheet cut-off length. It will be appreciated that such a change required utilization of a printing cylinder of different diameter so that an impression or blanket cylinder of equal working diameter would then necessarily be located nearer to or further from the axis of the printing cylinder in order to contact the printing cylinder. The main portion 21 of the mounting block may be replaced by another portion having the opening therein located closer to one side of the block than the other so as to relocate the bearing housing 19. In this manner it is possible to accommodate a change in cylinder diameters and thus a change in sheet cut-off in a printing press without changing the press side frames. The change in cylinder sizes is of the order of one inch in overall diameter and thus does not affect the ability of the press to print direct letterpress or offset on one of both sides of a web.

There has been described above a preferred embodiment of the present invention providing the capability of altering a printing press from letterpress or planographic printing to offset printing. The types of presses normally subjects to this type of change are very large with the impression cylinder weighing, for example, 4500 lbs. or so. Because of the massive nature of newspaper printing presses, for example, it is advantageous to accomplish the impression cylinder repositioning by means of the sectionalized mounting block disposed in the arcuate slot as described above. It is, however, possible to employ a unitary mounting block that is reversible in the side frame slot. This then accomplishes the desired change in the same manner as indicated in FIGS. 2A and 2B.

It is not intended to indicate herein that alteration of a press from letterpress or planographic printing to offset printing is accomplished in a matter of minutes and it will be appreciated that such a change normally only occurs once. It is, however, particularly noted that a single letterpress printing press may be modified for offset printing without the necessity of replacing the side frames of the press. The adjustment means for the mounting blocks of the present invention provide for precise setting of the impression or blanket cylinder for either letterpress or offset printing. It will be appreciated that conventional rotary newspaper printing presses printing by the letterpress or stereotype plate method employ printing plates having a thickness of the order of 7/16ths of an inch while planographic or offset printing is normally accomplished from a thin flexible printing plate wrapped about the printing cylinder and having a thickness of the order of 8 to 25 thousandths of an inch. Appropriate means may be provided on the printing cylinder or cylinders to accommodate attachment of either letterpress plates or offset plates, but proper letterpress or offset plate cylinders should be used and when the press is permanently changed over from letterpress or planographic to offset, or for the use of thin letterpress printing plates, the plate cylinder should be replaced with a proper cylinder for use with the type of printing plate to be used. The material employed as the cover for the impression or blanket cylinders may be conventional and are known in the art. A variety of different materials are employed as the blanket on impression cylinders whether the impression cylinders are in use in letterpress or offset presses and, inasmuch as these are commercially available, no description thereof is required. It is, however, noted that the blanket is removably attached to the cylinder.

It is to be noted that web lead 54 shown in FIG. 6A and FIG. 6B is shown in order to emphasize the importance that is placed on simplification of the web lead when printing by either the letterpress or offset methods.

In applying the present invention to a vertical press, wherein the web passes horizontally through the press, the arcuate slots extend outwardly from the cylinders and other elements are thus repositioned in accordance therewith.

What is claimed is:

1. In a rotary printing press having stationary main side frames for rotatably mounting a pair of printing cylinders in fixed spaced apart relationship and a pair of impression or blanket cylinders movable between mutually engaging and disengaging relationship, the improvement comprising said side frames each having a pair of arucate openings with each opening extending as a segment of a circle centered at the axis of one of said printing cylinders and the openings in each frame being at least partially disposed horizontally between the printing cylinders and extending from a slot bottom in horizontal disposition between the plate cylinders and curving upwardly therefrom and away from each other, an arcuate mounting block slidably disposed in each arcuate opening and each block carrying one of said cylinder bearings for an impression or blanket cylinder in an opening offset from the center of the block toward one end thereof with the offset being of sufficient length to displace said impression or blanket cylinders from engaging relationship when said blocks are turned end-for-end in said slots, to change the press from offset to letterpress, and threaded adjusting means mounted on said frame and extending into opposite ends of each arcuate opening for adjusting the position of said mounting blocks in the openings.

2. The improvement of claim 1 further defined by a second set of mounting blocks with each block of said second set carrying one of said cylinder bearings in an opening disposed closer to one arcuate side of the block than the other arcuate side for replacement of said first mentioned mounting blocks to reposition said impression or blanket cylinders to thereby accommodate a change in sheet cut-off length in said printing press without changing press side frames.

3. The improvement of claim 1 further defined by a coil spring disposed in each of said arcuate side frame openings in compression between the bottom of said openings and said mounting blocks for supporting only a part of the weight of impression cylinders carried by said bearing blocks.

4. In a rotary printing press having stationary side frames for rotatably mounting a pair of printing cylinders in fixed horizontally spaced relationship and a pair of impression or blanket cylinders movable between mutually engaging and disengaging relationship, the improvement comprising said side frames each having a pair of arcuate openings with each opening extending as a segment of a circle centered at the axis of one of said printing cylinders and the openings in each frame being at least partially disposed horizontally between the printing cylinders and curving upwardly and away from each other, an arcuate mounting block slidably disposed in each arcuate opening and each block carrying a cylinder bearing in an opening disposed closer to one end of the block than the other for rotatable mounting of one of said impression or blanket cylinders, each of said arcuate mounting blocks having a rotary mounted bearing housing carrying one of said cylinder bearings off-center therein to thus define an eccentric bearing mount with a lever extending from each housing to engagement with first threaded adjustment means for moving said eccentric bearing mount levers mounted upon the respective frame and including for each lever a pair of threadably adjustable members engageable with opposite sides of the lever and having locking means for fixing the position of said levers in controlled angular positions of the mount, and second threaded adjusting means mounted on said frame and extending into opposite ends of each arcuate opening for adjusting the position of each of said mounting blocks in its respective opening.

* * * * *